US009267223B2

(12) United States Patent
Schmidt

(10) Patent No.: US 9,267,223 B2
(45) Date of Patent: Feb. 23, 2016

(54) SINGLE- OR MULTIPLE-HEAD EMBROIDERY MACHINE HAVING A DOUBLE-LOCK-STITCH ROTATING GRIPPER

(75) Inventor: Gottlieb Schmidt, Stebach (DE)

(73) Assignee: ZOJE EUROPE GMBH, Kaiserslautern (DE)

( * ) Notice: Subject to any disclaimer, the term of this patent is extended or adjusted under 35 U.S.C. 154(b) by 72 days.

(21) Appl. No.: 13/636,852

(22) PCT Filed: Mar. 19, 2011

(86) PCT No.: PCT/EP2011/001369

§ 371 (c)(1),
(2), (4) Date: Nov. 8, 2012

(87) PCT Pub. No.: WO2011/116912

PCT Pub. Date: Sep. 29, 2011

(65) Prior Publication Data

US 2013/0055943 A1 Mar. 7, 2013

(30) Foreign Application Priority Data

Mar. 24, 2010 (DE) ..... 10 2010 013 046

(51) Int. Cl.
*D05B 57/14* (2006.01)
*D05C 9/02* (2006.01)

(52) U.S. Cl.
CPC . *D05B 57/14* (2013.01); *D05C 9/02* (2013.01)

(58) Field of Classification Search
CPC ..... D05B 57/14; D05C 9/02
USPC ..... 112/181–18, 455, 189, 190
See application file for complete search history.

(56) References Cited

U.S. PATENT DOCUMENTS

| | | | | |
|---|---|---|---|---|
| 4,121,527 | A * | 10/1978 | Johnson | 112/182 |
| 4,690,081 | A | 9/1987 | Castagna et al. | |
| 4,924,788 | A * | 5/1990 | Brown | 112/182 |
| 5,784,990 | A | 7/1998 | Shimizu et al. | |
| 5,839,382 | A | 11/1998 | Tice et al. | |
| 5,913,276 | A | 6/1999 | Kurono et al. | |
| 5,947,043 | A | 9/1999 | Morita et al. | |
| 7,565,873 | B2 * | 7/2009 | Yamasaki | 112/184 |
| 7,597,058 | B2 * | 10/2009 | Ishikawa et al. | 112/220 |
| 2008/0216722 | A1 | 9/2008 | Yamasaki | |
| 2009/0199752 | A1 | 8/2009 | James et al. | |

FOREIGN PATENT DOCUMENTS

| | | |
|---|---|---|
| CN | 200 967 877 Y | 10/2007 |
| CN | 201 386 195 Y | 1/2010 |

(Continued)

*Primary Examiner* — Danny Worrell
(74) *Attorney, Agent, or Firm* — McGlew and Tuttle, P.C.

(57) ABSTRACT

A single- or multiple-head embroidery machine has stitch-forming tools which are formed in each case by a thread-guiding needle that interacts with a double-lock-stitch gripper to form stitches, and also has a feed device for obtaining relative movements between the embroidery material and the stitch-forming tools. The relative movements occur depending on the movements of the needle. In order to avoid a temporal overlap between the stitch-forming phase and the feed movement of the embroidery material, the double-lock-stitch gripper rotates at a rotational speed which corresponds to n times the rotational speed of the machine main shaft, wherein "n" is an integer greater than the number "2".

20 Claims, 6 Drawing Sheets

(56) References Cited

FOREIGN PATENT DOCUMENTS

| | | | |
|---|---|---|---|
| DE | 40 36 436 | A1 | 9/1991 |
| DE | 42 17 848 | C1 | 6/1993 |
| DE | 197 51 083 | A1 | 5/1998 |
| DE | 199 06 433 | A1 | 8/2000 |
| EP | 1 972 710 | B1 | 9/2009 |
| WO | 2004/072349 | A2 | 8/2004 |

* cited by examiner

SINGLE- OR MULTIPLE-HEAD EMBROIDERY MACHINE HAVING A DOUBLE-LOCK-STITCH ROTATING GRIPPER

CROSS REFERENCE TO RELATED APPLICATIONS

This application is a United States National Phase application of International Application PCT/EP2011/001369 and claims the benefit of priority under 35 U.S.C. §119 of German Patent Application DE 10 2010 013 016.8 filed Mar. 24, 2010, the entire contents of which are incorporated herein by reference.

FIELD OF THE INVENTION

The invention relates to single- or multiple-head embroidery machines having stitch-forming tools which are formed by in each case a needle that interacts with a double-lock-stitch gripper to produce stitches, and have a feed device for obtaining relative movements between the embroidery cloth and the stitch-forming tools.

BACKGROUND OF THE INVENTION

The double-lock-stitch gripper which is predominantly used in this case is a rotating gripper that executes two complete rotations per stitch-forming period, as is employed hundreds of thousands of times as a "standard looper" in sewing machines and has proved very successful here too. This double-lock-stitch gripper requires a particular amount of thread tension for stitch forming, in particular for stitch insertion.

The use of a double lock stitch looper performing two full rotations per stitch-formation cycle and thus rotating two times per stitch formation is known in sewing machines, for example, through DE 42 17 848 C1.

The sewing machine disclosed here has, as is well known, a base plate, a column and an arm, which ends in a head. In the arm is mounted an arm shaft, which is in drive connection with a needle bar carrying a thread-guiding needle that is movable up and down in the head.

As is well known, a thread lever, which cooperates with the needle, which performs an up and down movement and which is likewise driven by the arm shaft, is also mounted in the head. However, the arm shaft is in drive connection via a belt drive or via a mechanical drive with a looper drive shaft mounted in the base plate of the sewing machine and drives same at a ratio of 1:2, so that the looper performs two rotations per each stitch-formation cycle, whereby the respective first rotation is used for detecting and expanding the needle thread loop, while the respective second rotation represents an "empty rotation," which has no effect on the stitch formation.

The different purposes of a sewn seam on the one hand and an embroidered seam on the other are the basis for a substantial difference between the requirements of a sewing machine and those of an embroidery machine. Whereas a sewn seam represents essentially a connecting or fastening seam, with which the usually two or more parts are connected firmly together, an embroidered seam represents a decoration (decorative seam) applied to the embroidery cloth, and transmits no forces at all.

The strength of the fastening seam is achieved in this case in that the thread loop dropped by the gripper is pulled by the thread lever with a relatively great force towards the top side of the article to be sewn so that the knotting of the needle thread and the gripper thread comes to lie centrally in the layers of material to be sewn together. The thread force of the gripper thread should also be calculated accordingly.

The conditions in the formation of an embroidered seam are completely different. Since in this case the needle thread (=embroidery thread) is only intended to lie cleanly on the top side of the embroidery material in order to obtain decorative effects, during the embroidery process the thread tension is kept as low as possible such that, while the embroidery thread is secured sufficiently in position on the embroidery cloth, no loose thread components arise and the knotting between the needle thread and the gripper thread always comes to lie on the underside of the embroidery cloth.

For this reason, a much lower tension of the needle thread is desired for embroidery machines compared with sewing machines.

Since, when the double-lock-stitch gripper that executes two rotations per stitch-forming period was transferred into the embroidery machine, the kinematics of said double-lock-stitch gripper were not adapted in an appropriate manner, even in current embroidery machines the feed movement for the embroidery cloth commences at a point in time at which the stitch-forming process has not yet been completed. This is very disadvantageous because as a result, when the thread lever starts to pull in the thread, the embroidery cloth has already moved by a considerable amount with respect to its position when the needle is inserted into the embroidery cloth. Consequently, the limb of the thread loop leading from the stitch hole to the thread store experiences in each case an additional deflection both when it emerges from the stitch hole and immediately after it passes through the embroidery cloth. The two deflections cause additional resistance when the thread is pulled in by the thread lever, and this additional resistance inevitably leads to an undesired increase in the minimum amount of thread tension.

This situation has a particularly disadvantageous effect in embroidery machines overall because, compared with sewing machines, they generally operate both with much greater stitch lengths and also with feed directions that extend in different directions.

SUMMARY OF THE INVENTION

An object of the invention is thus to create a solution which enables the minimum thread tension in embroidery machines having double-lock-stitch rotating grippers to be kept in the desired much lower region.

The invention is based on the knowledge that in double-lock-stitch gripper embroidery machines the stitch formation on the one hand and the feed movement of the sewing material on the other at least partially overlap, such that the feed movement of the sewing material already starts when the stitch formation has not yet been completed, i.e. the needle thread has not yet been pulled in fully by the thread lever.

In order to achieve the abovementioned object, it is proposed, in order to avoid the temporal overlap between the stitch formation and the feed movement of the material to be embroidered, to have the double-lock-stitch gripper rotate at a rotational speed which corresponds to n times the rotational speed of the main shaft of the embroidery machine, wherein "n" is an integer greater than the number "2".

On account of the fact that the double-lock-stitch gripper rotates for example at "n equals 3", the stitch formation—with respect to the rotational angle covered by the machine main shaft—ends, in a manner corresponding to the greater angular velocity of the double-lock-stitch gripper which is produced thereby, earlier than in the case of a double-lock-stitch gripper rotating at "n equals 2". The time window in which the stitch formation and the feed movement of the embroidery cloth are active at the same time is thus minimized.

Since double-lock-stitch grippers that rotate twice per stitch-forming period produce absolutely satisfactory results in the field of what are known as high-speed sewing machines with much faster rotational speeds, it is clear that the increase according to the invention in the rotational speed of the double-lock-stitch gripper has a negative effect on neither the quality of the seams produced nor on the mechanical strength.

Whereas in the above-described solution, the double-lock-stitch gripper rotates at a constant rotational speed that is "n times" the rotational speed of the machine main shaft, the object underlying the invention is also achieved by the double-lock-stitch gripper rotating at an angular velocity that can be changed periodically with respect to the main shaft of the machine, wherein the angular velocity of the double-lock-stitch gripper has the greater value during its working rotations and the in contrast smaller value during its idling rotations.

The invention is explained in more detail below with reference to an exemplary embodiment with corresponding drawings and diagrams. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
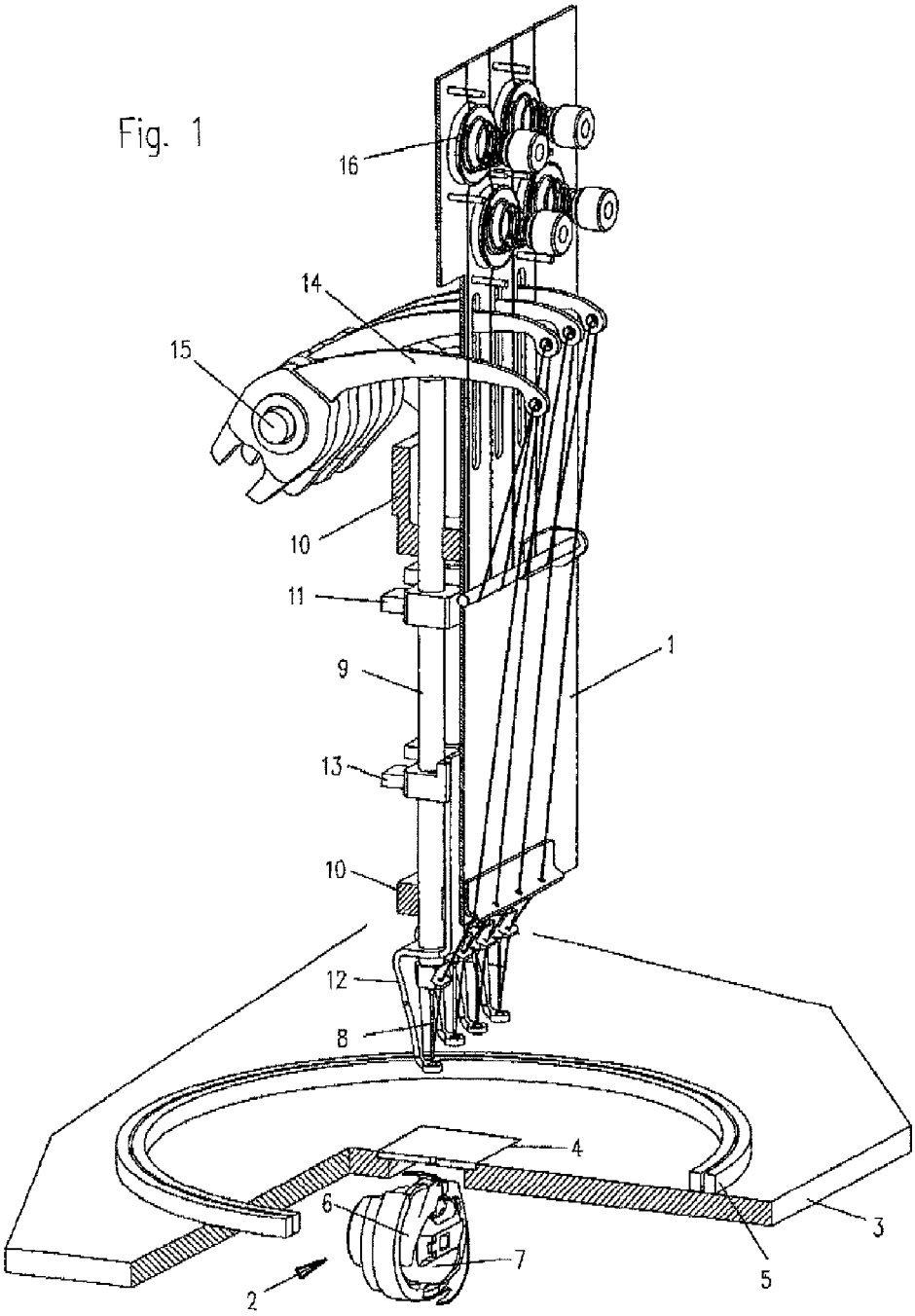
FIG. 1 is a partial sectional view of a front region of a conventional embroidery head having a double-lock-stitch gripper.

Referring to the drawings in particular, FIG. 1 shows a cross-sectional illustration of the front part 1 of a conventional embroidery head, which has a double-lock-stitch gripper 2, a table top 3 and a stitch plate 4. The embroidery frame 5, which can move freely in two axes and in which the embroidery cloth is clamped, rests on the table top 3. The double-lock-stitch gripper 2 is of a conventional design and has a bobbin case holder 6 for accommodating a bobbin case 7. The bobbin accommodating the gripper thread store is mounted rotatably in the bobbin case 7.

The needle bar 9 interacting with the double-lock-stitch gripper 2 and bearing a needle 8 is held in a vertically moveable manner in a basic frame 10 and is driven in a manner known per se by a driver 11 which transmits the drive movement of the needle drive to the needle bar 9. Furthermore provided per embroidery thread at the front part 1 of the embroidery head is a holding-down device 12, which is arranged in a displaceable manner on the needle bar 9 and is driven by a driver 13. Furthermore arranged per embroidery thread at the front part 1 of the embroidery head is a thread lever 14 which is driven in a known manner and is mounted pivotably on an axle 15, which is in turn accommodated in the basic frame 10. Finally, the embroidery head has a thread brake 16 which can be adjusted in a known manner and is fitted in a stationary manner on the front part 1.

The rear part of the embroidery head, which is not illustrated in any more detail, is fixedly connected to the machine frame and carries the drives for the needle bar 9, the holding-down device 12 and the thread lever 14. The rear part of the embroidery head is furthermore connected to the front part 1 via a linear guide, which is not illustrated in more detail, so that said front part 1 can be displaced within a vertical plane in the direction of alignment of the available needle bars 9 above the double-lock-stitch gripper 2, wherein in each case a needle bar 9, a holding-down device 12 and a thread lever 14 are connected to the respective drive.

The abovementioned parts, with the exception of the drive of the double-lock-stitch gripper 2 are driven by a machine main shaft (not shown), which executes one complete, i.e. 360°, rotational movement per stitch-forming period. Whereas in the prior art the double-lock-stitch gripper 2 rotates at twice the rotational speed, i.e. at "n=2", according to the invention the double-lock-stitch gripper 2 rotates at "n=an integer greater than the number 2". Accordingly, in the exemplary embodiment shown of the invention, a step-up gearing having a step-up ratio of "n=3" is provided between the machine main shaft and the double-lock-stitch gripper 2.

Figure 2:
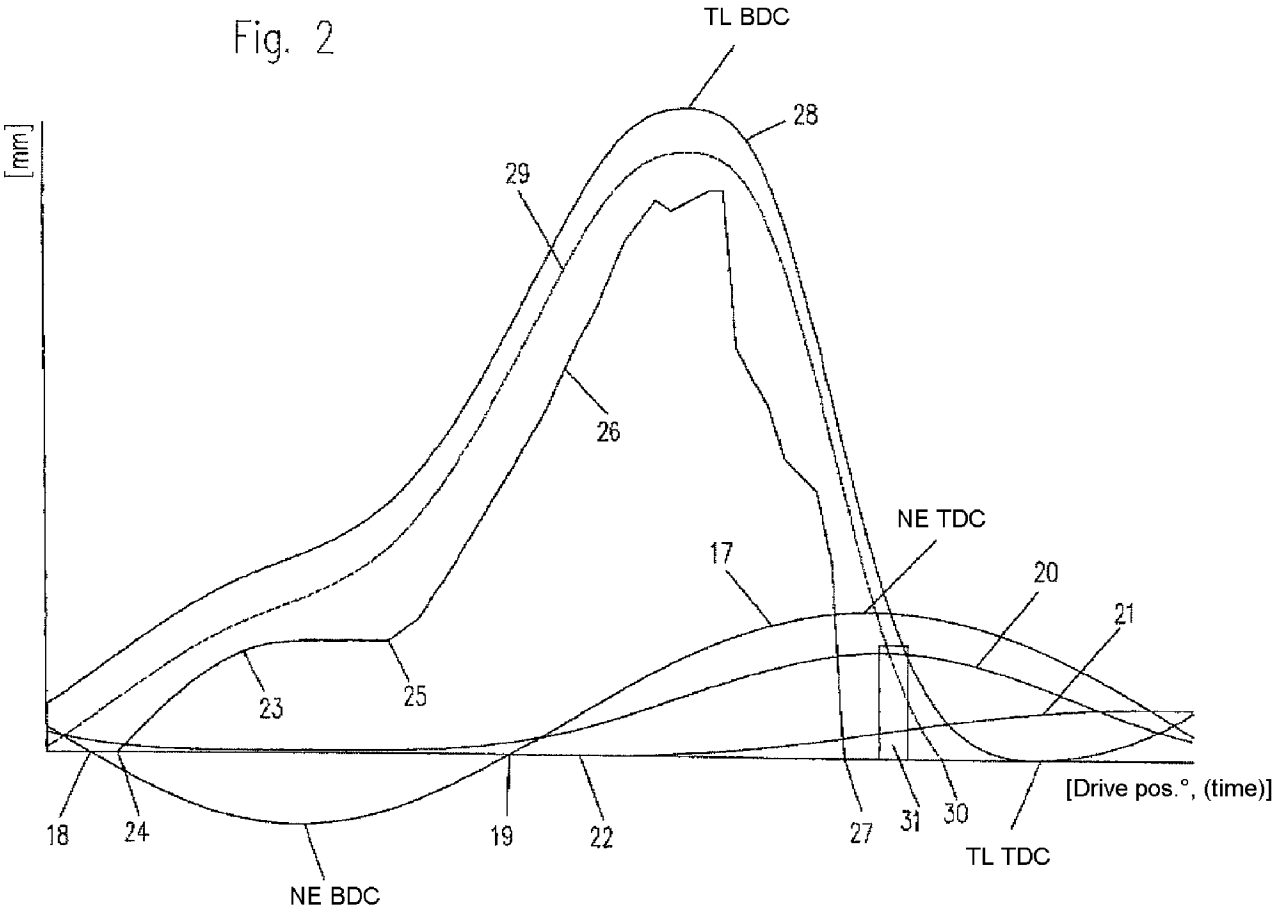
FIG. 2 is a displacement/time diagram of the movements of the stitch-forming tools and the feed device according to the prior art, having temporarily overlapping time windows for stitch formation and the feed movement.

To understand the invention, reference is first of all made to FIG. 2, which shows the typical movement diagram of the known kinematic interaction of the needle 8 with a double-lock-stitch gripper 2 rotating twice according to the prior art, and also of the feed device (not shown) and the holding-down device 12 over one rotation of the machine main shaft.

The graph 17 illustrates the movement of the tip of the needle 8 with respect to the surface of the stitch plate. At the time 18, the needle tip dips through the stitch hole and under the surface of the stitch plate 4 and at the time 19 it rises back above the latter.

The graph 20 depicts the lifting movement and the distance of the underside of the holding-down device 12 above the stitch plate 4.

The graph 21 shows the progress of the embroidery frame movement relative to the last needle insertion point at the time 18 on the embroidery cloth.

The embroidery frame starts to move at the time 22 and thus shortly after the time 19, which corresponds to the time at which the needle 8 emerges from the stitch plate 4. The embroidery frame stops moving at the end of the diagram.

All the values of this movement function are scaled linearly as a constant factor with the variable stitch length (=distance of the last insertion point 18 to the future needle insertion point).

The graph 23 represents the thread requirement of the needle 8, starting at the time 24, when the eye thereof dips downwards under the surface of the embroidery cloth. At the time 25, the tip of the double-lock-stitch gripper 2 passes into the needle thread loop formed by the needle 8, as a result of which the double-lock-stitch gripper 2 assumes control of the needle thread. Its thread requirement is illustrated by the graph 26. The tip of the double-lock-stitch gripper 2 first of all widens the thread loop presented to it by the needle 8 and then guides it about the bobbin case 7 arranged inside the double-lock-stitch gripper 2. Subsequently, the thread requirement of the double-lock-stitch gripper 2 decreases again until the gripper completely releases the needle thread again at the time 27. The double-lock-stitch gripper 2 is thus in contact with the needle thread only in the time between the points 25 and 27. This corresponds at most to 180° of the 360° of the stitch-forming period; the rest of the time, the double-lock-stitch gripper 2 runs idly, i.e. the double-lock-stitch gripper 2 does not come back into contact with the needle thread until the subsequent stitch-forming period.

Standing opposite the thread requirement of the needle 8 and the double-lock-stitch gripper 2 is the thread feed corresponding to graph 28. Said thread feed is a function of the pivot position of the thread lever 14 about its axle 15. The thread feed according to the graph 28 has an excess compared with the thread requirement (23, 26). This serves as a reserve, from which the stitch-length-dependent thread consumption is taken from the previous stitch cycle.

The thread feed 28 is reduced by the amount of this thread consumption and so the effective thread feed is identical to the graph 29. Said thread consumption is only taken off the needle thread store by the thread lever 14 in the time period between the time 30 and the thread lever TDC and in the process the system thread length (=the entire length of the needle thread between the thread brake 14 and the stitch plate 4) is equalized again at the highest pivot point of the thread lever 14.

The length of the time window for the movement of the embroidery frame represents a difference from the diagram of a serving machine. In the case of the sewing machine, this is approximately 120°. In the case of the gripper embroidery machine, however, it is 180° or even more. The embroidery frame starts to move at the time 22 and is therefore correspondingly brought forward in time in the prior art. Although this is a necessary concession to the numerically controlled embroidery frame drive independent of the embroidering mechanics, it leads, with respect to the amount of thread tension required, to a not inconsiderable disadvantage in terms of embroidery.

The bringing forward in time of the start of the displacement movement of the embroidery frame into the period clearly before the time at which thread insertion by the thread lever 14 ends to complete the stitch that has been started leads to the embroidery cloth moving relative to the stitch plate 4 before the end of the thread insertion.

Figure 4:
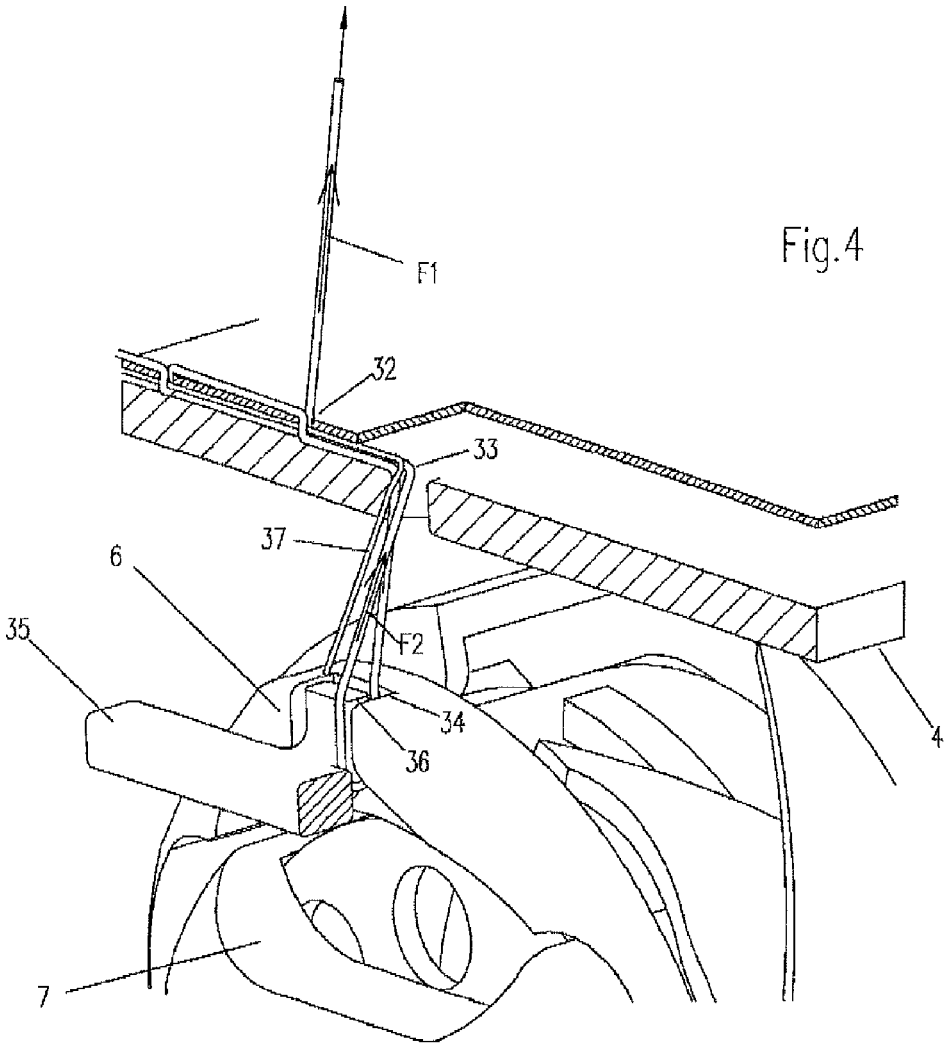
FIG. 4 is a partial sectional view showing the situation of the thread loop on passing through at the torque support (stopping piece) of the bobbin case holder of the double-lock-stitch gripper corresponding to the time window 31 in FIG. 2—according to the prior art.

It can be seen in FIG. 4 that, in order to secure the bobbin case holder 6 against rotational movement, a radially directed groove 34 is provided thereon and a stationary stopping piece 35 having a nose engages into said groove, with the result that the needle thread can be moved through between the stopping piece 35 and the lateral delimiting surface 36 of the groove 34.

If, in the case of stitch lengths greater than 2 mm, the last insertion point of the needle 8 has been displaced more than one millimeter from the centre of the stitch hole at the time 18 by the movement of the embroidery cloth according to graph 21 in the time region 31, two deflections 32, 33 (FIG. 4) of the needle thread occur on the path between the thread lever 14, the groove 34 and the stopping piece 35. The thread force F1 directed towards the thread lever in the region of the needle thread above the embroidery cloth is first of all reduced by thread friction at the deflection 32 and then again at the deflection 33, in a total of two steps. What is left is the force F2. This is the force which is required to open the thread passage between the stopping piece 35 and the lateral delimiting surface 36 of the groove 34.

The magnitude of the force F2 is predetermined by the stitch-forming process and therefore cannot be changed. In order that it reaches the value predetermined by the system again, the thread force F1 must be raised by a factor "K" of approximately 2.5, even in the case of favourable material pairings. In the case of unfavourable material pairings (cotton thread/cotton embroidery cloth) this factor "K" tends towards the value of 4. The thread force F1 increased in this way corresponds to the minimum retaining force of the thread brake 16 when the thread is pulled in by the thread lever 14.

Figure 5:
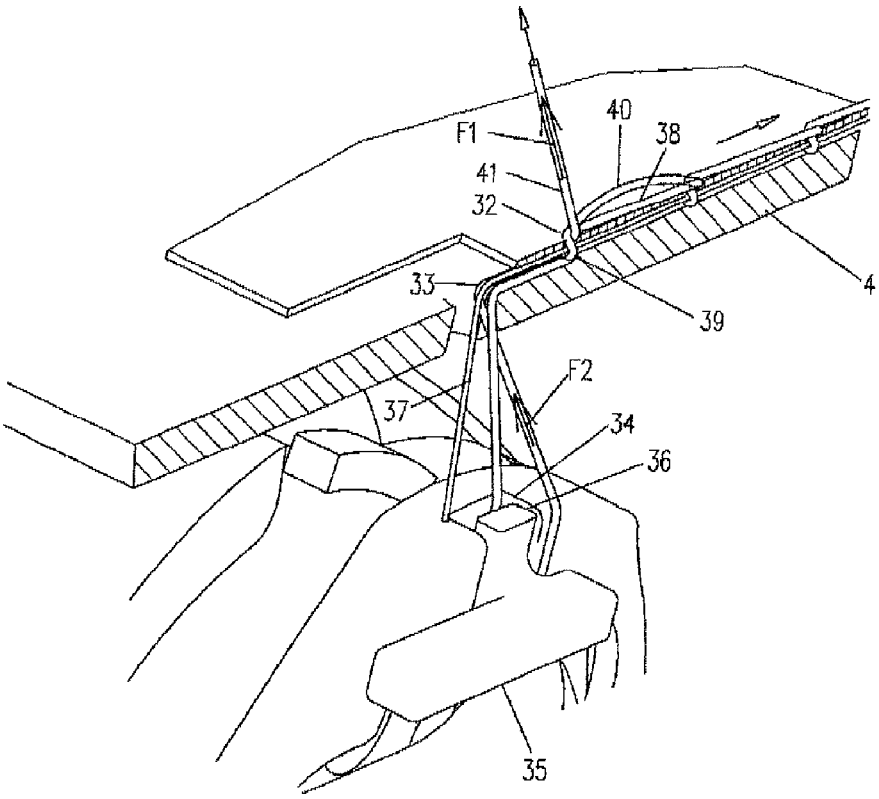
FIG. 5 a partial sectional view showing a situation as in FIG. 4, but illustrated for a different direction of the feed movement of the embroidery frame.

FIG. 5 shows the conditions for the time window 31, in which the thread lever 14 pulls on the thread loop and opens the thread passage between the nose of the stopping piece 35 and the lateral delimiting surface 36 of the groove 34, wherein the feed movement of the embroidery cloth with respect to its feed movement in FIG. 4 is reversed and takes place in the direction of the arrow in FIG. 5. This corresponds approximately to the situation in which what are known as loop threads are produced during sewing or embroidery. In this case, the needle thread is looped not only with the gripper thread 37 but also with itself. In the case of a sewing machine, this transporting direction and situation hardly ever occur.

However, in the case of a gripper embroidery machine, it occurs regularly. The more intensive looping at the thread deflection point 32 increases the factor "K" further. Once the needle thread loop has passed through the thread passage, the needle thread tension drops virtually to zero. The thread lever 14 decreases the size of the needle thread loop further until it has been completely minimized at the point 30. On the way to this point, the needle thread part 38 which hitherto lay flat on the embroidery cloth is formed into a thread loop 40 protruding above the embroidery cloth by friction of the needle thread at the knotting 39 with itself. This thread loop 40 has to be pulled back in, in the time period 30 up to the thread lever (TDC). This is all the more successful, the steeper the needle thread part 41 becomes to the eye of the needle and in this case leaves the surface of the embroidery cloth. This steepness decreases according to trigonometric laws along with the path of the embroidery cloth transport covered up to this point (according to graph 21, this is already 75% of the stitch length). Depending on the coefficient of friction of the needle thread used, it is only possible to pull in the thread loop 40 safely up to an associated maximum stitch length.

As emerges from the description with regard to FIGS. 4 and 5, the circumstances, which increase the necessary thread tension, are based on the fact that the thread passage between the stopping piece 35 and the lateral delimiting surface 36 of the groove 34 only take place in the middle of the current, already advanced feed movement of the embroidery cloth. This is the result of the temporal overlap between the activities of the gripper or the stitch formation with the activities of the embroidery cloth transport or of the feed device.

It is thus clear that the bringing forward in time of the start of the feed movement of the embroidery frame into the temporal region of the pulling up of the needle thread by the thread lever 14 leads to an unavoidable increase in thread tension. It is precisely this that is undesirable in embroidery machines, however.

Figure 3:
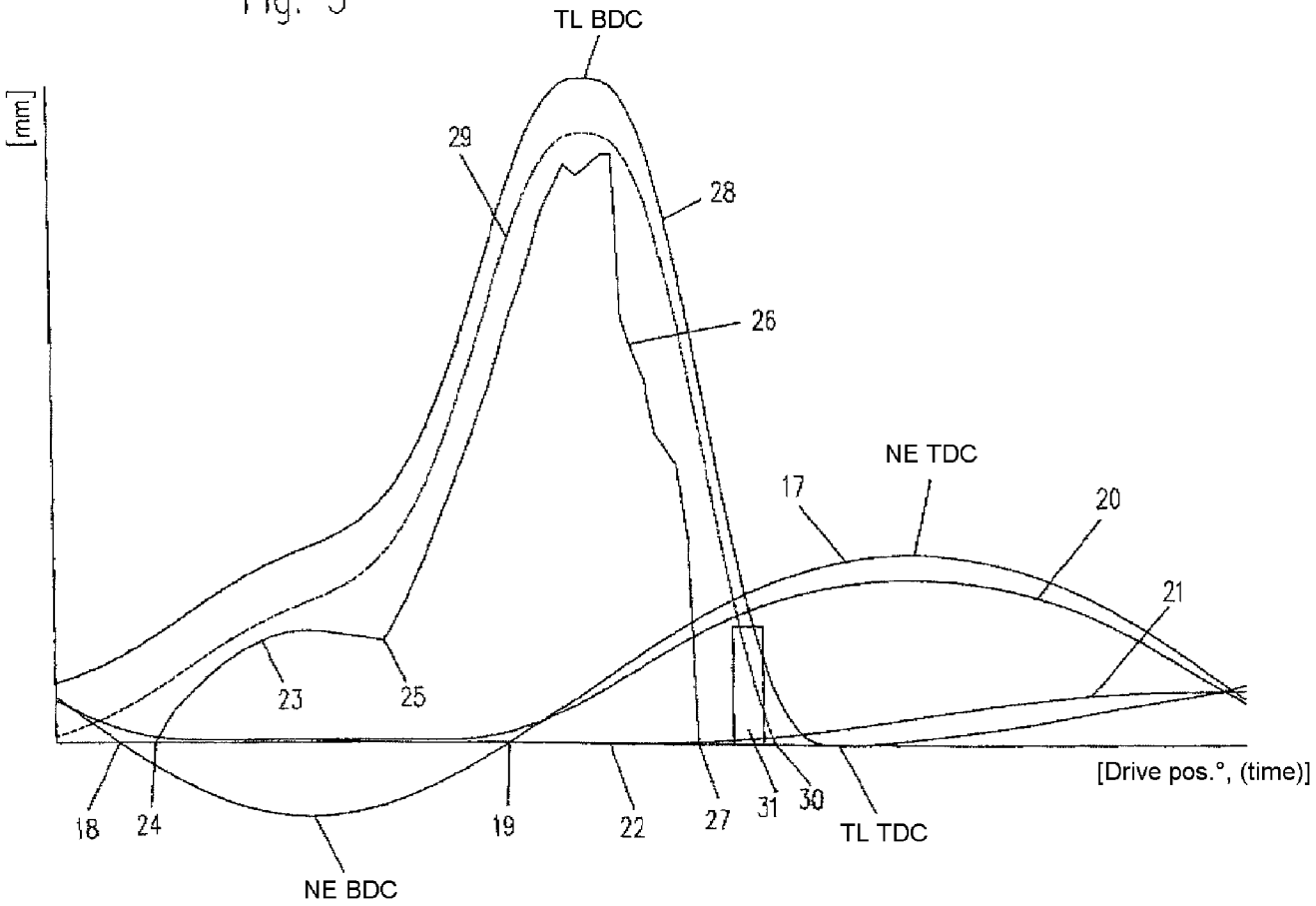
FIG. 3 is a displacement/time diagram of the movements of the stitch-forming tools and the feed device according to the invention.

The diagram of the movement of the stitch-forming tools that is shown in FIG. 3 in accordance with the invention corresponds to the diagram according to FIG. 2 with the exception of the movement of the double-lock-stitch gripper 2 and the course, which is dependent thereon, of the graph 26, 28 and 29 representing the thread requirement and the thread release.

On account of the fact that the double-lock-stitch gripper rotates for example at "n equals 3", the stitch formation—with respect to the rotational angle covered by the machine main shaft—takes place, in accordance with the greater angular velocity produced here of the double-lock-stitch gripper, earlier than in the case of the double-lock-stitch gripper rotating at "n equals 2". This means that the thread loop is released by the double-lock-stitch gripper 2—with respect to the rotational angle of the machine main shaft—at an earlier time than the double-lock-stitch gripper that rotates twice, and thus the point in time 27 marking the loop release by the double-lock-stitch gripper is displaced towards the left in the diagram according to FIG. 3 compared with its position in the diagram according to FIG. 2.

Figure 6:
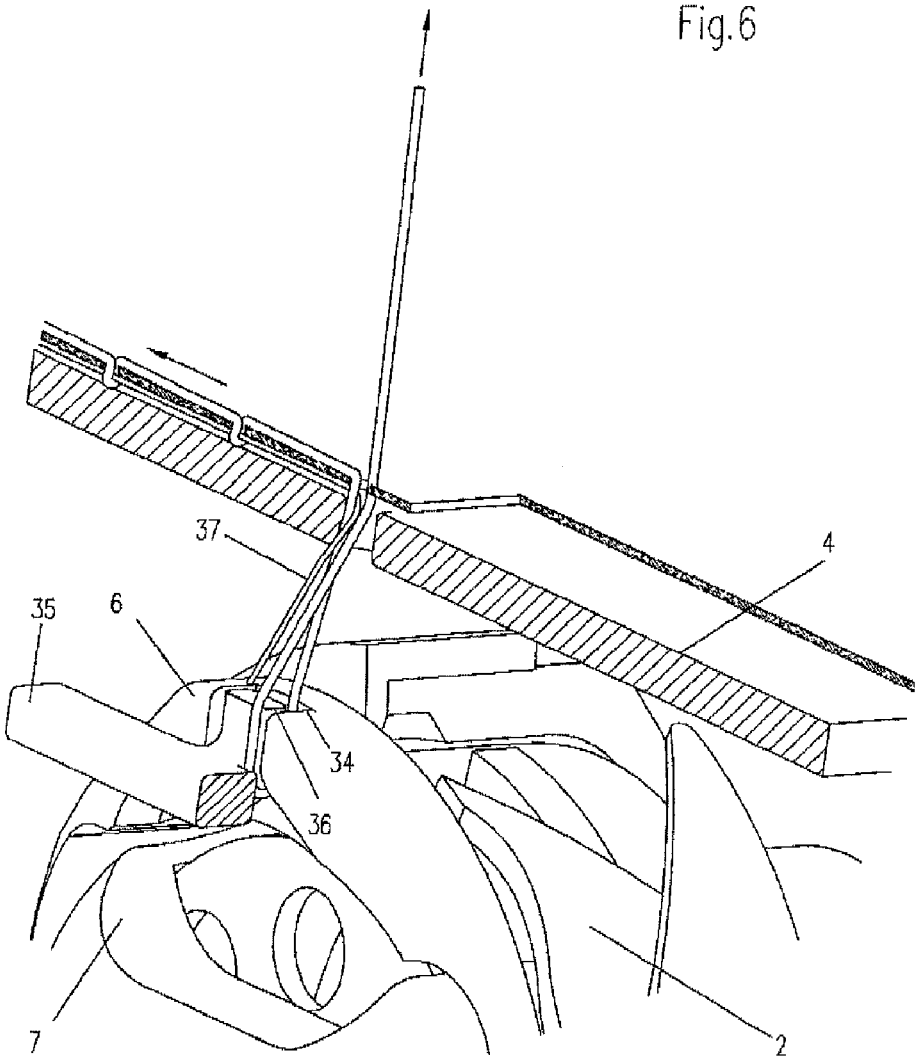
FIG. 6 is the situation of the thread loop on passing through at the torque support (stopping piece) of the bobbin case holder of the double-lock-stitch gripper—corresponding to the time window 31 in FIG. 3—according to the invention.

In this way, the movement of the thread lever 14 to pull in the looping of needle and gripper threads that is formed can start—with respect to the rotational angle of the machine main shaft—at a correspondingly earlier time, with the result that the thread lever 14 reaches the top dead centre (TDC) of its movement path correspondingly earlier and thus the stitch formation is concluded—with respect to the rotational angle of the machine main shaft—correspondingly earlier. Stitch formation and feed are thus disentangled in time. The result is illustrated in FIG. 6, which shows the situation of the thread loop shortly before the thread lever (TDC), when the rest of the thread loop passes through the thread passage between the stopping piece 35 and the lateral delimiting surface 36 of the groove 34. The resistance to be overcome in the process by the thread represents the system-required minimum thread force (=tension) when a rotating gripper is used.

Compared with FIGS. 4 and 5, the respective thread deflection points on the stitch plate and in the embroidery cloth and also in the limb of the thread loop moving towards the needle are no longer present. Accordingly, the high frictional forces and thus the previously required increase in the thread retaining force by the factor of 2.5 to 4 with respect to the minimum thread force are also dispensed with on account of the omission of the thread deflections. Thus, the present invention enables operation of a gripper embroidery machine with a thread tension which, for reasons of functional reliability of stitch formation, is only slightly higher than the system-required minimum tension.

While specific embodiments of the invention have been shown and described in detail to illustrate the application of the principles of the invention, it will be understood that the invention may be embodied otherwise without departing from such principles.

The invention claimed is:

1. A single- or multiple-head embroidery machine comprising:

stitch-forming tools comprising a thread-guiding needle that interacts with a double-lock-stitch gripper to form stitches;

a feed device for obtaining relative movements between an embroidery material and the stitch-forming tools, said relative movements occurring depending on movements of the needle, wherein in order to reduce a temporal overlap between a stitch-forming phase and the feed movement of the embroidery material, the double-lock-stitch gripper rotates at a rotational speed which corresponds to n times a rotational speed of a main shaft, wherein "n" is an integer greater than the number "2";

a step-up gearing having a step-up ratio of 1:3 arranged between the machine main shaft and the double-lock-stitch gripper.

2. A single- or multiple-head embroidery machine according to claim 1, wherein said double-lock-stitch gripper and said thread-guiding needle form embroidering stitch-forming tools, said embroidering stitch-forming tools interacting with said double-lock-stitch gripper to form embroidered stitches, said embroidering stitch-forming tools further comprising a thread lever and a holding down device.

3. A single- or multiple-head embroidery machine according to claim 2, wherein said embroidered stitches comprises embroidery thread.

4. A single- or multiple-head embroidery machine according to claim 3, wherein said embroidered stitches form an embroidered seam.

5. A single- or multiple-head embroidery structure comprising:

one of a single-head embroidery machine and a multiple-head embroidery machine comprising a main shaft, a drive for rotating said main shaft, stitch-forming tools and a feed device, said stitch-forming tools comprising a thread-guiding needle and a double-lock-stitch gripper, said thread-guiding needle being moved based on movement of said main shaft, said thread-guiding needle interacting with said double-lock-stitch gripper to form embroidered stitches, said feed device providing relative movements between an embroidery material and said stitch-forming tools, said relative movements occurring based on movements of the needle, wherein the double-lock-stitch gripper rotates at a rotational speed which is equal to n times a rotational speed of the main shaft, wherein n is an integer greater than two such that a temporal overlap is prevented between a stitch-forming phase and the feed movement of the embroidery material.

6. A single- or multiple-head embroidery machine according to claim 5, wherein said thread-guiding needle and said double-lock-stitch gripper form embroidering stitch-forming tools, said embroidering stitch-forming tools further comprising a thread lever and a holding down device, wherein said double-lock-stitch gripper is rotated via a double-lock-stitch gripper drive.

7. A single- or multiple-head embroidery machine according to claim 6, wherein said embroidered stitches comprises embroidery thread.

8. A single- or multiple-head embroidery machine according to claim 7, wherein said embroidered stitches form an embroidered seam.

9. A single- or multiple-head embroidery machine according to claim 7, further comprising a step-up gearing having a continuously constant step-up ratio of 1:3 arranged between the machine main shaft and the double-lock-stitch gripper, wherein said double-lock-stitch gripper is rotated via said drive and said step-up gearing.

10. A single- or multiple-head embroidery machine according to claim 6, wherein said one of said single-head embroidery machine and said multiple-head embroidery machine further comprises an embroidery frame for clamping embroidery material, said embroidery frame being freely movable in two axes.

11. A single- or multiple-head embroidery machine according to claim 5, wherein said stitch-forming tools further comprise another thread-guiding needle and another double-lock-stitch gripper to form a plurality of said stitch-forming tools, said another thread-guiding needle interacting with said another double-lock-stitch gripper.

12. A single- or multiple-head embroidery machine according to claim 1, wherein an embroidery machine comprises said stitch-forming tools, said feed device and said step-up gearing.

13. A single- or multiple-head embroidery machine according to claim 12, wherein said embroidery machine further comprises an embroidery frame for clamping the embroidery material, said embroidery frame being freely movable in two axes.

14. A single- or multiple-head embroidery machine according to claim 13, wherein said embroidery machine further comprises a main shaft drive, said main shaft being rotated via said main shaft drive, said main shaft drive rotating said gearing such that said double-lock-stitch gripper rotates at said rotational speed which is equal to n times the rotational speed of the main shaft via said step-up gearing.

15. A single- or multiple-head embroidery machine according to claim 13, wherein said stitch-forming tools comprises another thread-guiding needle and another double-lock-stitch gripper to form a plurality of said stitch-forming tools, said another thread-guiding needle interacting with said another double-lock-stitch gripper.

16. A single- or multiple-head embroidery structure comprising:

one of a single-head embroidery device and a multiple-head embroidery device comprising a main shaft, a drive for rotating said main shaft at a main shaft rotational speed, stitch-forming tools and a feed device, said stitch-forming tools comprising a thread-guiding needle and a double-lock-stitch gripper, said thread-guiding needle being moved based on movement of said main shaft, said thread-guiding needle interacting with said double-lock-stitch gripper to form embroidered stitches, said feed device providing relative movements between an embroidery material and said stitch-forming tools, said relative movements occurring based on movements of the needle, said double-lock-stitch gripper being rotated at a double-lock-stitch gripper rotational speed, said double-lock-stitch gripper rotational speed being greater than two times said main shaft rotational speed.

17. A single- or multiple-head embroidery machine according to claim 16, further comprising a step-up gearing having a continuously constant step-up ratio of 1:3 arranged between the machine main shaft and the double-lock-stitch gripper, wherein said double-lock-stitch gripper is rotated via said drive and said step-up gearing.

18. A single- or multiple-head embroidery machine according to claim 16, wherein said thread-guiding needle and said double-lock-stitch gripper form embroidering stitch-forming tools, said embroidering stitch-forming tools further comprising a thread lever and a holding down device.

19. A single- or multiple-head embroidery machine according to claim 18, wherein said embroidered stitches comprises embroidery thread.

20. A single- or multiple-head embroidery machine according to claim 19, wherein said embroidered stitches form an embroidered seam, wherein said one of said single-head embroidery machine and said multiple-head embroidery machine further comprises an embroidery frame for clamping the embroidery material, said embroidery frame being freely movable in two axes, wherein said stitch-forming tools further comprise another thread-guiding needle and another double-lock-stitch gripper to form a plurality of said stitch-forming tools, said another thread-guiding needle interacting with said another double-lock-stitch gripper, said double-lock-stitch gripper being rotated via a double-lock-stitch gripper drive.

* * * * *

UNITED STATES PATENT AND TRADEMARK OFFICE

CERTIFICATE OF CORRECTION

PATENT NO. : 9,267,223 B2
APPLICATION NO. : 13/636852
DATED : February 23, 2016
INVENTOR(S) : Schmidt It is certified that error appears in the above-identified patent and that said Letters Patent is hereby corrected as shown below:

Title Page

Item (30)
Please correct the Foreign Application number as DE 10 2010 013 016.8

Signed and Sealed this
Third Day of May, 2016

Michelle K. Lee

Michelle K. Lee
*Director of the United States Patent and Trademark Office*